United States Patent [19]

Bartlett et al.

[11] Patent Number: 4,931,129

[45] Date of Patent: Jun. 5, 1990

[54] CARPETS

[75] Inventors: Ian G. Bartlett, Grovedale; Donald A. Lymer, Highton, both of Australia

[73] Assignee: Tybar Engineering Pty., Ltd., Victoria, Australia

[21] Appl. No.: 296,401

[22] Filed: Jan. 9, 1989

Related U.S. Application Data

[60] Continuation of Ser. No. 5,468, Jan. 20, 1987, abandoned, which is a division of Ser. No. 707,463, Mar. 1, 1985, Pat. No. 4,678,533.

[30] Foreign Application Priority Data

Mar. 7, 1984 [AU] Australia ..... PG3952

[51] Int. Cl.[5] ..... D04H 11/08; D05C 15/06

[52] U.S. Cl. ..... 156/435; 83/402; 112/80.7

[58] Field of Search ..... 156/72, 435; 226/97; 83/913, 98, 100, 402; 112/80.07, 80.08, 80.71, 80.7; 66/214

[56] References Cited

U.S. PATENT DOCUMENTS

| | | | |
|---|---|---|---|
| 3,424,114 | 1/1969 | Short | 112/80.08 |
| 3,531,343 | 9/1970 | Couquet | 156/72 |
| 3,697,344 | 10/1972 | Temple | 156/72 |
| 3,937,643 | 2/1976 | Spanel | 156/435 |
| 3,945,545 | 3/1976 | Bacro | 226/97 |
| 4,416,205 | 11/1983 | Schwartz | 112/80.7 |

*Primary Examiner*—George F. Lesmes
*Assistant Examiner*—J. Davis
*Attorney, Agent, or Firm*—Brumbaugh, Graves, Donohue & Raymond

[57] ABSTRACT

An apparatus and method for manufacture of carpet is disclosed where yarn bits are forced onto an adhesive covered backing. Yarn is moved through an outlet and severed after application to the backing. Also disclosed is a yarn feed device and a multicolor carpet printer.

3 Claims, 5 Drawing Sheets

CARPETS

This application is a continuation of application Ser. No. 005,468, filed on Jan. 20, 1987, now abandoned which, in turn, is a divisional of appln. Ser. No. 707,463 filed Mar. 1, 1985 U.S. Pat. No. 4,679,533.

The present invention relates to the manufacture of carpets.

In a conventional tufted carpet the carpet yarn is pushed through a material backing (known as the primary backing) and then pulled through the backing to form a U-shaped tuft. To ensure that the tufts do not move from the primary backing a coating of adhesive, usually latex is glued to the primary backing which locks in the base of each tuft to the carpet. To provide dimensional stability when the carpet is laid a secondary backing is usually glued to the latex. This secondary backing also improves the aesthetic appearance of the rear of the carpet. Accordingly, depending on the thickness of both the yarn and the primary backing, a percentage of each tuft is either within or below the primary backing and does not form part of the exposed carpet surface. This wastage, due to the tufting technique of forming carpets, can be considerable and may account for up to 30% of the yarn.

Accordingly, it is an object of one aspect of the present invention to provide a carpet manufacture technique where such wastage is avoided.

A further object of another aspect of the present invention is to provide an improved spray device for printing of multicolour carpets.

Accordingly in one aspect of the invention there is provided a method for manufacture of carpet, said method including the steps of forcing or guiding onto an adhesive covered backing a plurality of cut yarns.

Preferably said yarn is supplied from at least one outlet situated above said backing, said at least one outlet including at least one guide means for guiding yarn through said at least one outlet from a yarn supply, and said yarn is severed by a cutting device when said yarn emerges from said at least one outlet. In a preferred embodiment an air channel, adapted to be connected to a compressed air supply, leads into each guide means to force said yarn through the guide means.

In a further aspect of the present invention there is provided an apparatus for manufacture of carpet, said apparatus including at least one yarn outlet situated above an adhesive covered backing, said at least one outlet including at least one guide means for guiding yarn through said at least one outlet from a yarn supply, and a cutting device for severing said yarn emerging from said at least one outlet.

Furthermore the invention provides a yarn feed device for a machine requiring yarn to be fed thereto, said device including first and second synchronized yarn clamping means, a yarn puller means located between said first and second yarn clamping means, said first yarn clamping means releasing said yarn when said yarn puller means pulls a predetermined length of yarn from a yarn supply means and said second yarn clamping means releasing said yarn when said predetermined length of yarn is required by said machine.

In a still further aspect the invention provides a spray device for dye or paint, said device including a mixing chamber having a spray outlet coupled thereto and at least two dye or paint inlets into said chamber with said inlets adapted to be connected to respective dye or paint pressure vessels.

The invention also provides a carpet printer including transport means for moving carpet to be printed, a spray device for dye positioned above said carpet and extending the width of said carpet, said spray device including a plurality of spaced apart mixing chambers, each mixing chamber having a spray outlet coupled thereto and at least two dye inlets opening into said mixing chamber with said inlets connected to respective dye pressure vessels.

In order that the invention may be clearly understood and readily put into practical effect, preferred non-limitative embodiments constructed in accordance with the invention will now be described with reference to the accompanying drawings, in which.

Figure 1:
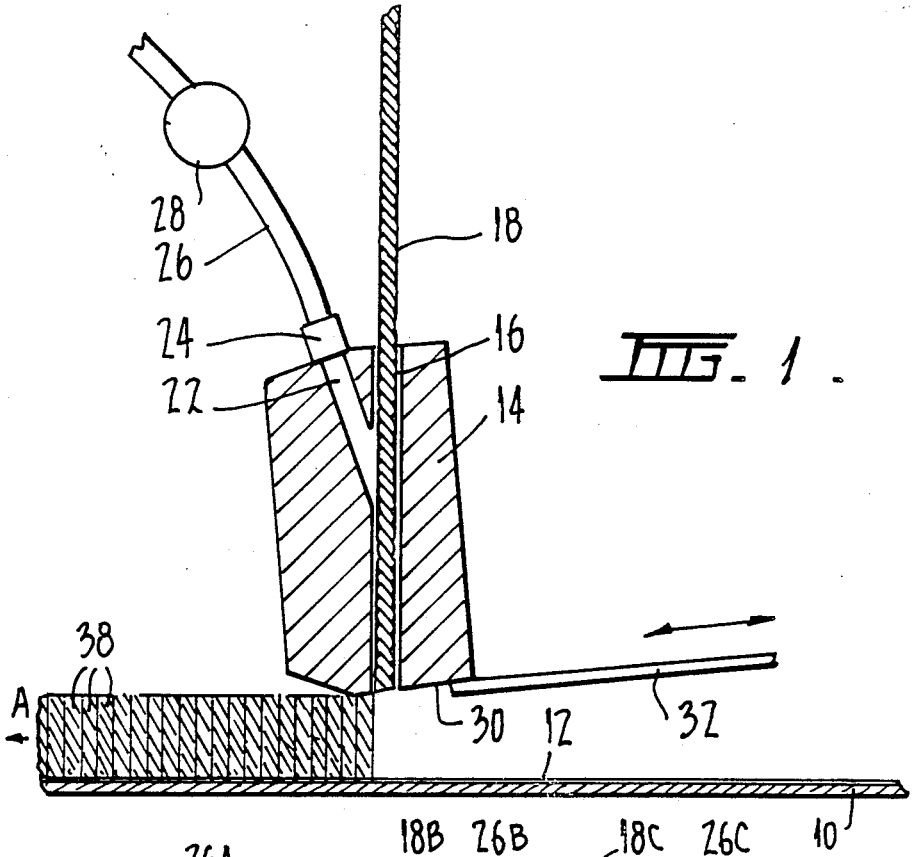
FIG. 1 is a cross-sectional side view of a first embodiment of an apparatus for manufacturing carpet made in accordance with one aspect of the present invention.

With reference to the first embodiment shown in FIG. 1 there is disclosed a backing 10 to which has been applied an adhesive or glue 12. Backing 10 is conveyed right to left as indicated by arrow A. An outlet or manifold 14 consists of an elongated body which extends across the width of backing 10. A yarn guide, in the form of bore 16 is drilled into manifold 14 and a plurality of these guides also extend the width of the backing. Yarn 18 is fed into bore 16 from a yarn feed (not shown). A further bore 22 opens into bore 16 and has a hose coupling member 24 secured therein. An air hose 26 connects member 24 to a control solenoid 28 which is coupled to a compressed air supply (not shown).

On base 30 of manifold 14 is a cutting device in the form of a reciprocating knife 32 for severing yarn 18 where it emerges from the manifold.

In use, the knife 32, solenoid(s) 28 and movement of the backing 10 are synchronized by machine controls (not shown). As backing 10 moves under manifold 14 solenoid 28 is opened and the pulse of air in further bore 22 forces yarn 18 into the adhesive 12 of the backing. Knife 32 then severs yarn 18 to form the upstanding carpet tuft 38. This sequence of operation is repeated to form the carpet.

Any suitable adhesives may be used but the use of resilient rather than stiff adhesives are preferred as they give the carpet flexibility and bounce. It has been found that bore 16 should preferably be angled towards the direction of travel of backing 10 to ensure that the tufts are not angled when cut by knife 32. The height of manifold 14 can also be adjusted to allow production of various depths of pile.

Figure 2:
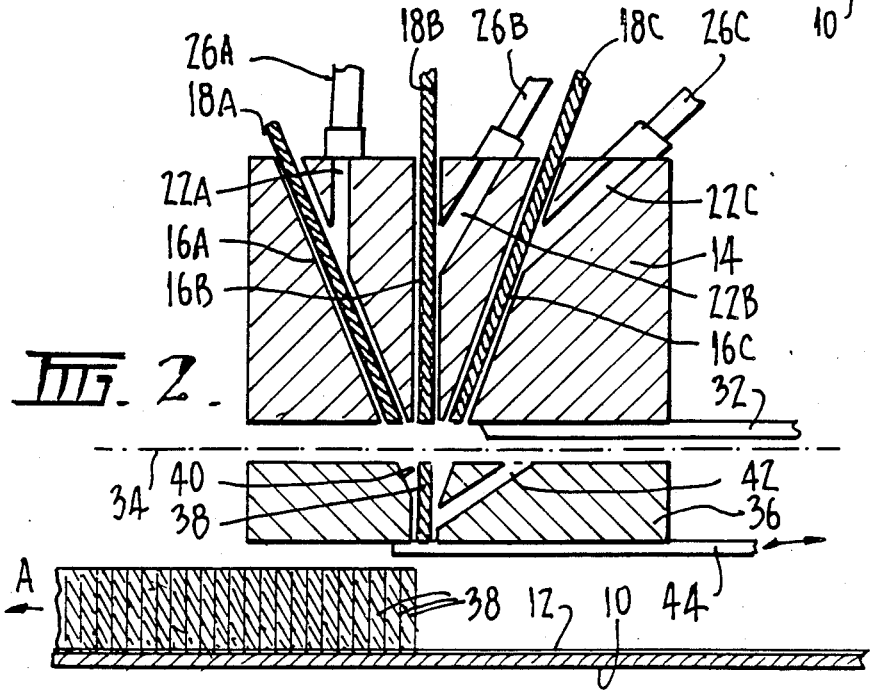
FIG. 2 is a cross-sectional side view of second and third embodiments of an apparatus for manufacturing carpet made in accordance with one aspect of the present invention.

Turning to FIG. 2 there are shown two embodiments which use multiple yarns to produce an "Axminster" type carpet. With Axminster carpet dyed carpet yarns are used which are woven to form the desired pattern. The use of such individual yarns produces a sharp delineation between the interface of different coloured yarns. Such a sharp delineation is not possible with tufted carpets because the coloured patterns are printed on the carpet which results in colour bleed at the interface of the different coloured dyes. The present invention can use coloured yarns to give an "Axminister" carpet effect. In FIG. 2 the same numerals are used where possible for ease of explanation and comparison. Dotted line 34 separates the two embodiments with the second embodiment including only the components above dotted line 34 whereas the third embodiment also includes the components below dotted line 34.

In the second embodiment the difference over the first embodiment is the use of multiple bores 16A, 16B and 16C together with corresponding further bores 22A, 22B and 22C. Yarns 18A, 18B and 18C are of different colours and are fed from respective yarn feeds (not shown). If coloured yarn 18B is required the appropriate solenoid (not shown) would be activated and a pulse of air along air hose 26B will force yarn 18B into adhesive 12 of backing 10. As the other bores have not been activated yarns 18A and 18C will not move. By selection of the activated bores a multicolour carpet can thus be produced.

The third embodiment shown in FIG. 2 includes an assembler block 36 which correctly positions the cut yarn bit 38 over backing 10. Block 36 has a conical bore 40 for guiding yarn bit 38. Air passage 42 is connected to an air hose (not shown) and a pulse of air is provided by a solenoid (not shown) in a similar manner to that of further bores 22A, 22B and 22C. A movable slide 44 blocks conical bore 40 when yarn bit 38 is cut and acts in synchronism with air passage 42. In use the yarn bit 32 will be cut and drop into conical bore 40 to be held in block 36 by slide 44. When required slide 44 will be retracted and a pulse of air delivered down air passage 42 to force yarn bit 38 into adhesive or glue 12 on backing 10. This embodiment allows the yarn bit 38 to be released at the correct angle despite the initial angle from which the yarn bit was delivered to assembler block 36.

Figure 3:
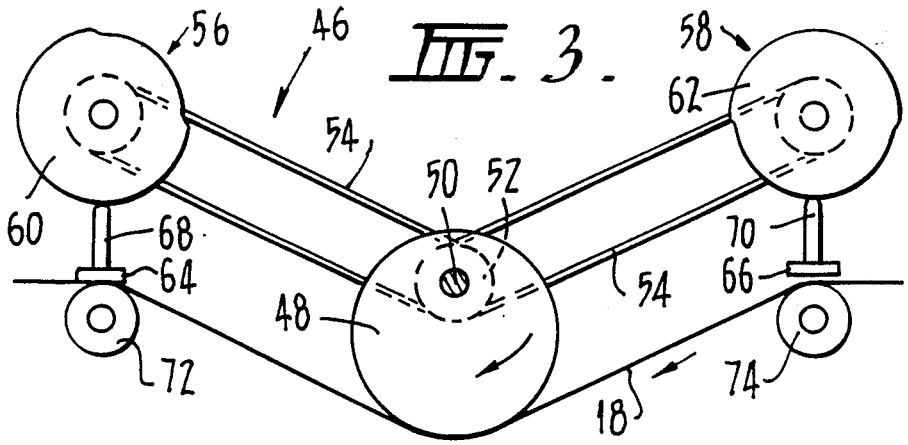
FIGS. 3 to 5 are side views of a yarn feeder in various operational positions made in accordance with a further aspect of the present invention.
Figure 4:
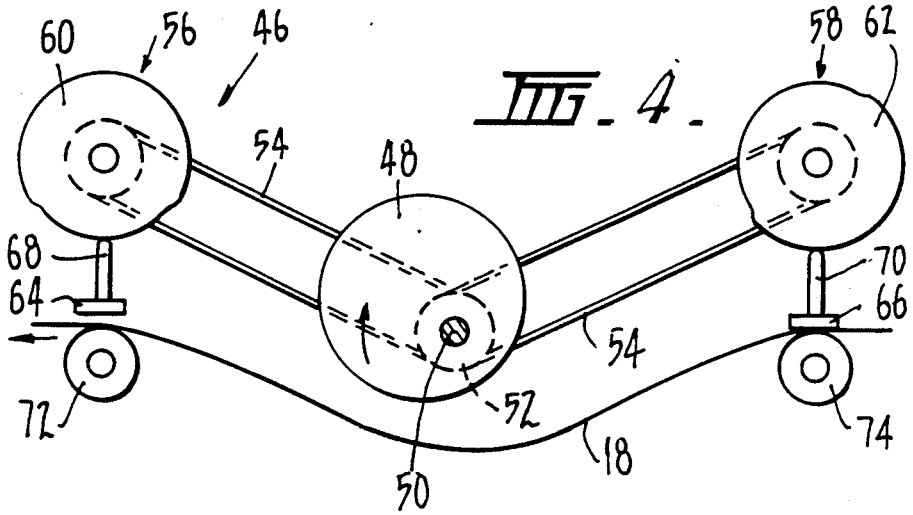
Figure 5:
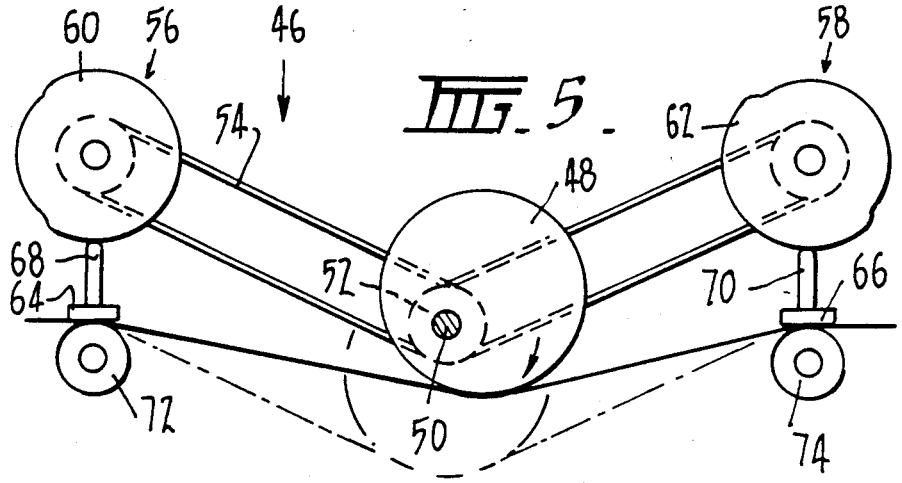

FIGS. 3 to 5 show a yarn feed device 46 which may be used to supply yarn 18 to the apparatus shown in FIG. 1. The device has an eccentric 48 with axle 50. A pulley or chainwheel 52 is coupled to belts or chains 54 (shown only in FIG. 3) to rotate eccentric 48. On either side of eccentric 48 are clamping means 56 and 58. In this embodiment the clamping means consist of rotatable cams 60 and 62 and clamping plates 64 and 66. Plates 64 and 66 are secured to cam followers 68 and 70. Yarn 18 is, in use, clamped between clamping plates 64, 66 and rods 72 and 74.

The operation of the yarn feed device will now be described. Turning to FIG. 3 eccentric 48 is at 0° with clamping means 56 closed and clamping means 58 open. At this position yarn 18 has been pulled from a creel (not shown) by the action of eccentric 48. At 60° clamping means 58 is closed and yarn cannot be withdrawn from the creel. Yarn 18 will hang down slackly between clamping means 56 and 58. At 135° clamping means 56 is open whilst clamping means 58 remains closed (see FIG. 4). At 180° solenoid 28 (FIG. 1) is activated and a pulse of air pulls the slack yarn through manifold 14 onto adhesive or glue 12. Accordingly the yarn between clamping means 56 and 58 will be tightened as the slackness has been withdrawn. Between 230° and 330° knife 32 will sever yarn 18. At 225° clamping means 56 is closed (see FIG. 5). At 270° clamping means 58 is open whilst clamping means 56 remains closed. In this position yarn 18 is again withdrawn from the creel by the engagement of the eccentric on yarn 18. This action then returns the eccentric to 0°. It is clear from the above that the angles defined are non-limitative and are given to show the sequence of operations.

Figure 6:
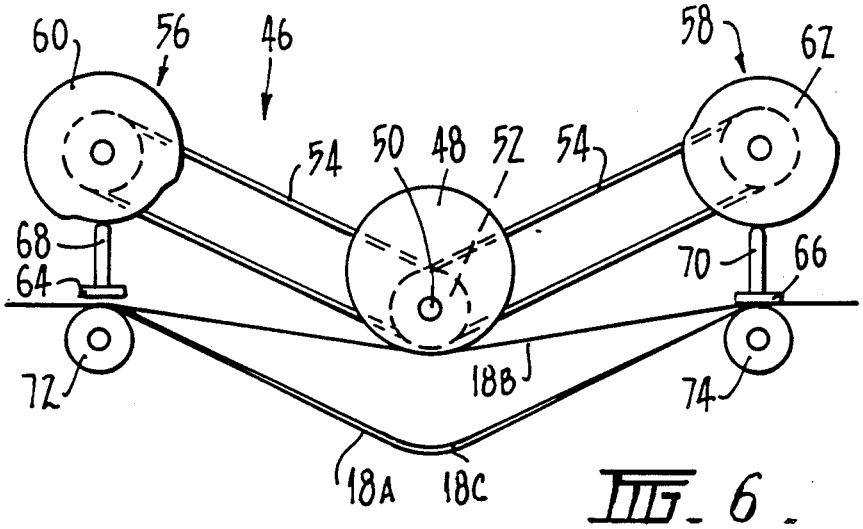
FIG. 6 is a similar view to that of FIGS. 3 to 5 showing feeding of multiple yarns.

In FIG. 6 the yarn feed device 46 of FIGS. 3 to 5 is shown being used with 3 yarns 18A, 18B and 18C as required by the apparatus described with reference to FIG. 2. In FIG. 6 eccentric 48 will withdraw all yarns 18A, 18B and 18C from their respective creels but only the selected yarn (18B as described with reference to FIG. 2) will be pulled through clamping means 56 when the solenoid for further bore 22B is activated. Accordingly yarns 18A and 18C will remain slack until their respective solenoid is activated. It is clear that the clamping means will extend across the width of backing 10. The clamping means need not be cam operated as other devices may be used e.g. solenoids.

In production the backing 10 may be formed of a scrim of a polyethylene terephthalate (PET) coated with an adhesive. The yarn is then fired into the adhesive. Suitable adhesives include:

(a) P.V.C.—A variety of PVC-plastisols can be formulated from PVC resins and various plasticizers, stabilizers, fillers and pigments. A typical formulation is:

| PVC resin | 100 (parts by weight) |
|---|---|
| Plasticizer | 70 |
| Stabilizer | 1.5–2.0 |
| Filler | 15–20 |
| Pigment | as required. |

For maximum strength, a PVC adhesive has to be cured at a temperature between 150°–200° C. Hence, a carpet formed using a PVC-plastisol would be passed through a curing oven.

(b) Hot melt adhesive—Several hot melt adhesives such as ethylene vinyl acetate and atactic polypropylene types may be used. These adhesives are applied to the scrim as hot fluids, and kept molten until the tufts are fired. On cooling the tufts are adhered to the scrim. A scrim may be pre-coated with a hot melt adhesive and stored away, and the adhesive can be re-melted as tufting commences.

(c) Latex—A latex adhesive compounded from butadiene/styrene resins, stabilizers, filters and pigments may also be used. This adhesive would also need to be cured at temperatures between 180°–200° C. after the tufting process.

The invention may also be used to manufacture carpet tiles. Here, a 500 cm × 500 cm PVC tile with a scrim incorporated (for dimensional stability) is coated with a layer of PVC-plastisol adhesive, into which yarns are fired to form the surface of the carpet tile. The tile is then cured in a gas or infra red oven.

It is clear from the above description that the invention results in considerable savings in both time and resources. As the backing does not have to be penetrated all the yarn is used as pile for the carpet. Accordingly, for the same length of carpet the invention will use considerably less yarn. As a secondary backing is not required to be glued onto the primary backing the cost and time involved in its placement are also saved.

Figure 7:
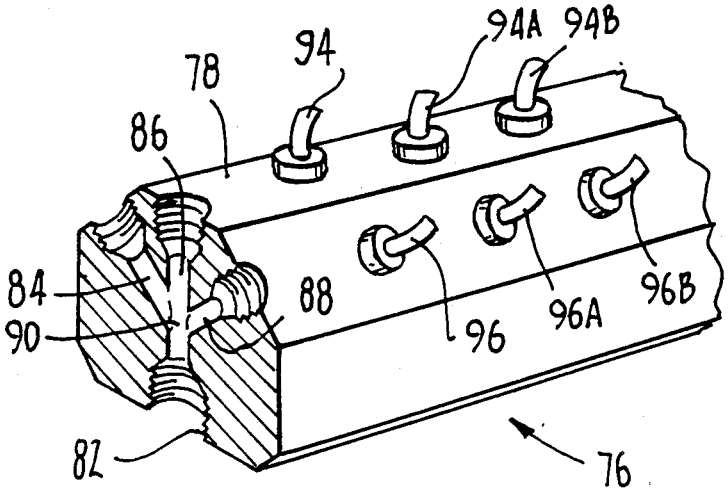
FIG. 7 is a perspective cross-sectional view of a spray device made in accordance with yet a further aspect of the present invention.
Figure 8:
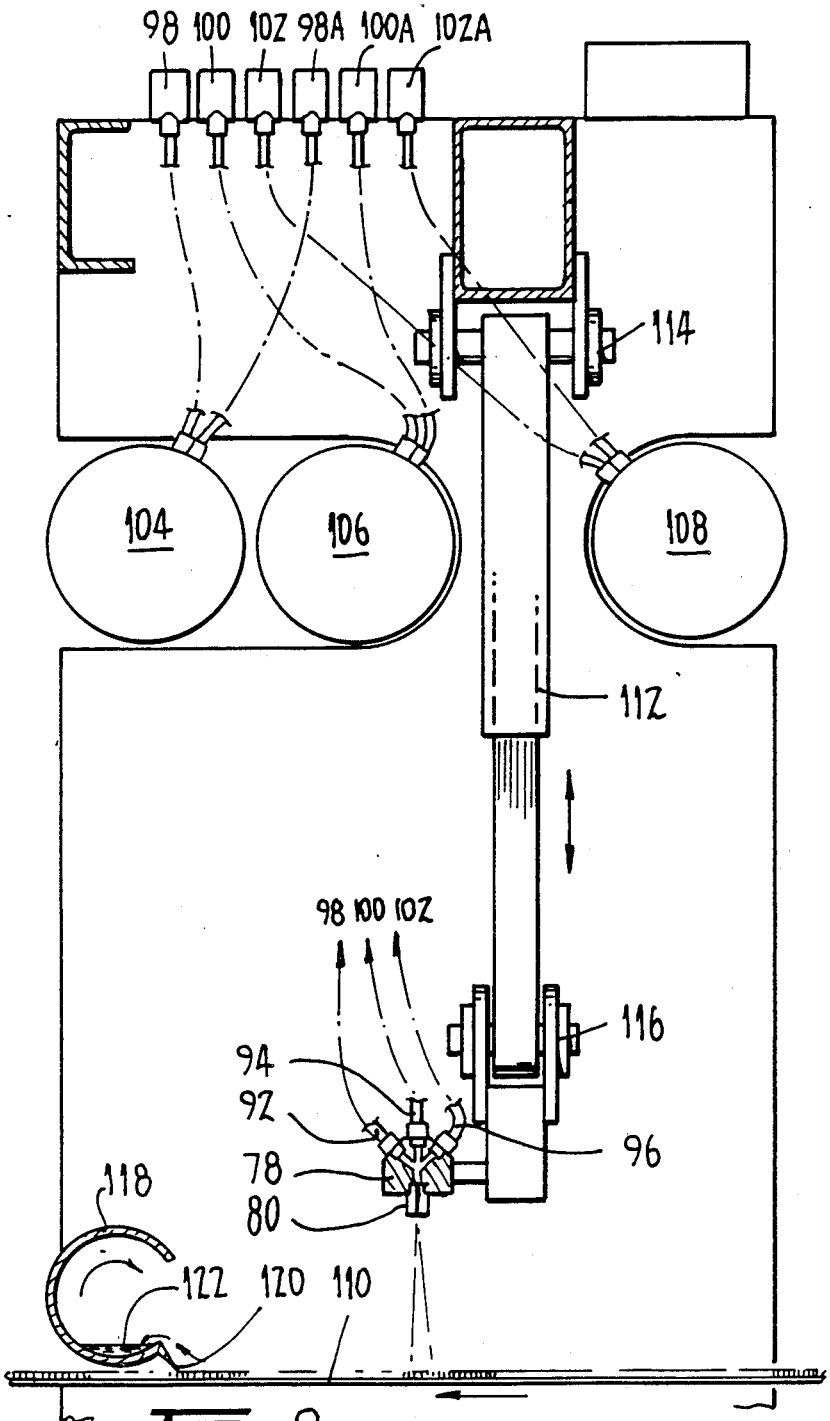
FIG. 8 is a cross-sectional side view of a carpet printer incorporating the spray device shown in FIG. 7.
Figure 9:
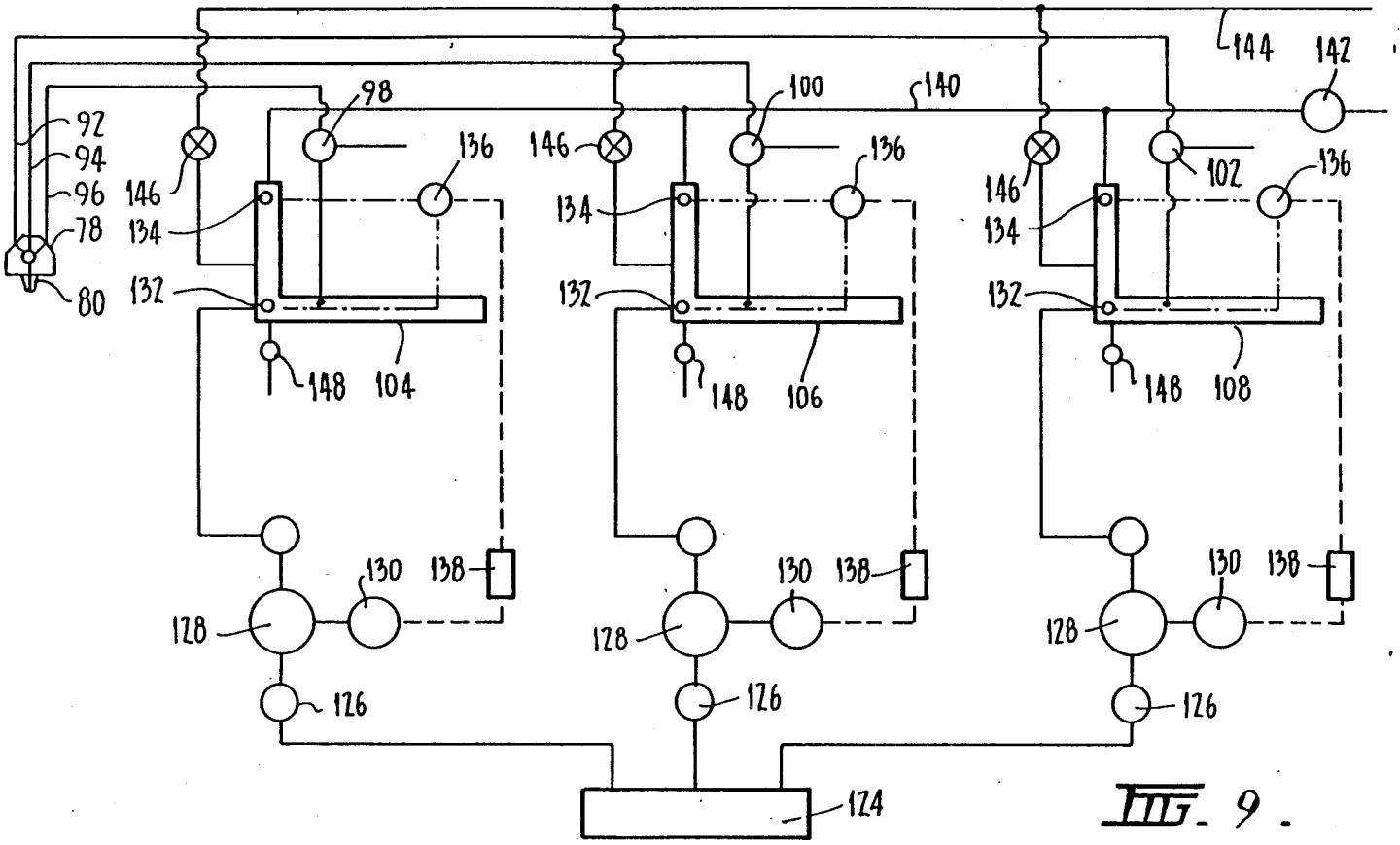
FIG. 9 is a schematic representation of the construction and operation of the carpet printer shown in FIG. 8.

Turning to FIGS. 7, 8 and 9 there is shown a spray device 76 for dyeing carpet. A manifold 78 has a spray outlet or tip 80 (see FIGS. 8 and 9) which is screwed into outlet bore 82. A plurality of inlet bores 84, 86 and 88 open into a mixing chamber 90 which leads into outlet bore 82. Each inlet bore is coupled by hoses 92, 94 and 96, via solenoids 98, 100 and 102, to dye pressure vessels or headers 104, 106 and 108. Manifold 78 extends the full width of the carpet 110 to be dyed and includes a plurality of spray tips 80. The manifold 78 may comprise a solid rod with the inlet and outlet bores drilled therein (as shown in this embodiment), or individual disks or sections joined together to form the manifold.

The carpet printer shown in FIGS. 8 and 9 has manifold 78 being supported by swinging arms 112 which are adjustable in length to vary the position of the manifold above carpet 110. Bearings 114 and 116 allow the swinging movement to occur. The swinging movement is a very slow controlled oscillation to avoid striations or a "tramtrack" effect on the printed carpet. To collect the dye mist that can spot the printed carpet a tubular gutter 118 is located downstream of manifold 78 and located just above the carpet. Inclined ramp 120 tends to guide the mist into gutter 118 (as shown by the arrows) and the mist can coalesce and form a pool 122 which may be readily drained.

From FIG. 9 the remaining components to complete the carpet printer are shown. Only one spray tip 80 is shown and only single solenoids 98, 100 and 102 are shown for each dye pressure vessel or header 104, 106 and 108. Each dye pressure vessel or header is coupled to a coupling board 124 for supply of the appropriate dye. The dye is strained by strainer 126 before entering pump 128 powered by DC motor 130. The dye level inside dye pressure vessel or header is monitored by upper and lower pressure transducers 134 and 132. These transducers are coupled to a differential pressure cell 136 interfaced to a DC motor controller 138. Thus as dye is used cell 136 will force controller 138 to increase pump speed to fill the vessel or header. A compressed air line 140 has a regulator 142 and has branches to supply each vessel or header. For ease of cleaning a rinse water line 144 is provided with ball valves 146 and drain valves 148.

In use, the dye pressure vessels 104, 106 and 108 are filled with the desired dyes. The final colour emerging from spray tip 80 will be dependent on the colour of the dyes and the combination in which they are applied. Accordingly precise control over the final colour can be obtained. At the intersection of the inlet bores with the outlet bore (which forms mixing chamber 90) the mixing of the individual dyes is very thorough and results in a very uniform final colour. The mixing chamber and outlet bore are constructed so as to set up a turbulent flow to ensure this thorough mixing. Depending on the colours required it is not necessary to utilize all of the dye pressure vessels 104, 106 and 108. Accordingly two vessels may be used, or manifold 78 could include more than three inlets, depending on circumstances. The use of three base colours can result in up to seven different colour combinations.

It is believed that the invention and many of its attendant advantages will be understood from the foregoing description and it will be apparent that various changes may be made in the form, construction and arrangement of the parts and that changes may be made in the form, construction and arrangement of the apparatus, yarn feeder or spray device described without departing from the spirit and scope of the invention or sacrificing all of its material advantages, the form hereinbefore described being merely a preferred embodment thereof.

We claim:

1. Apparatus for manufacturing tufted carpet of the type in which the ends of rows of yarn bits are implanted in an adhesive covering on a sheet of backing, said apparatus comprising:

a manifold comprising an elongated stationary body having upper and lower surfaces, said body extending across the width of an adhesive covered sheet of backing adapted to be moved stepwise under said body along a horizontal path spaced from said lower surface a fixed distance equal to a desired tuft height and in a direction of travel perpendicular to the width dimension of said sheet, said body having a plurality of guide bores extending substantially vertically therethrough between the upper and lower surfaces and uniformly distributed in a row along the length dimension of said body, each of said guide bores having a yarn outlet at said lower surface and being connected at said upper surface to a respective yarn supply for guiding yarn from a supply through a respective yarn outlet in the lower surface of said body in a direction substantially perpendicular to said sheet of backing;

first control means for controllably forcing yarn from respective yarn supplies through said guide bores comprising a like plurality of air channels formed in said body each leading into a respective guide bore and adapted for connection to a supply of compressed air through a first control valve operative to momentarily apply compressed air to said channels to force through each guide bore a respective strand of yarn of sufficient length that the free end of individual uncut yarns emerging from the yarn outlets in the lower surface of said body is embedded in the adhesive covering on said sheet of backing without the use of any vertically moving parts, and yarn cutting means comprising a knife mounted for reciprocating engagement with the lower surface of said body and cooperating with said body and operative after the free ends of individual uncut yarns are embedded in said adhesive coating for simultaneously severing the plurality of yarns where they emerge from the yarn outlets in the lower surface of said body thereby to form a row of upstanding carpet tufts having a height substantially equal to said fixed distance between the lower surface of said body and said path of travel of said sheet of backing.

2. The apparatus as defined in claim 1, wherein said elongated body has at least one further set of a like plurality of guide bores extending between the upper and lower surfaces thereof and uniformly distributed in a row along the length dimension of said body, each guide bore of said further set having a yarn outlet at said lower surface aligned, along the direction of travel of said sheet, with one of said plurality of guide bores and being connected at said upper surface to a respective yarn supply for guiding yarn from a supply through a respective yarn outlet in the lower surface of said body, the guide bores of said further set being disposed at an angle with respect to respective guide bores of said plurality; and second control means for controllably forcing yarn through the guide bores of said further set, independently of said first control means, comprising a further set of air channels formed in said body each leading into a respective guide bore of said further set and adapted for connection to a supply of compressed air through a second control valve operative to momentarily apply compressed air to said further set of air channels to force through each guide bore of said second set a respective strand of yarn of sufficient length that the free end of individual uncut yarns emerging from the yarn outlets in the lower surface of said body is embedded in the adhesive covering on said sheet of backing closely adjacent to the free ends of the yarns that emerge from the yarn outlets of said plurality of guide bores.

3. Apparatus as defined in claim 1, wherein said guide bores are inclined slightly from vertical in the direction of travel of said sheet of backing for ensuring that the embedded yarn tufts are not angled when being severed by said yarn cutting means.

* * * * *

UNITED STATES PATENT AND TRADEMARK OFFICE

CERTIFICATE OF CORRECTION

PATENT NO. : 4,931,129

DATED : June 5, 1990

INVENTOR(S) : Bartlett etal

It is certified that error appears in the above-identified patent and that said Letters Patent is hereby corrected as shown below:

Column 1, line 7, "4,679,533" should read --4,678,533--.

Signed and Sealed this

Twenty-fourth Day of November, 1992

*Attest:*

DOUGLAS B. COMER

*Attesting Officer*

*Acting Commissioner of Patents and Trademarks*